US008104551B2

(12) United States Patent
Nakamura

(10) Patent No.: US 8,104,551 B2
(45) Date of Patent: Jan. 31, 2012

(54) EXCAVATION TOOL

(75) Inventor: Kazuyoshi Nakamura, Anpachi-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 177 days.

(21) Appl. No.: 12/733,064

(22) PCT Filed: Jul. 28, 2008

(86) PCT No.: PCT/JP2008/063499

§ 371 (c)(1),
(2), (4) Date: Feb. 5, 2010

(87) PCT Pub. No.: WO2009/019999

PCT Pub. Date: Feb. 12, 2009

(65) Prior Publication Data

US 2010/0236831 A1 Sep. 23, 2010

(30) Foreign Application Priority Data

Aug. 6, 2007 (JP) ..... 2007-204174

(51) Int. Cl.
*E21B 10/62* (2006.01)

(52) U.S. Cl. ..... 175/432; 299/113; 403/346

(58) Field of Classification Search ..... 175/432; 299/113, 104, 103; 407/102; 403/165, 350, 403/348, 346

See application file for complete search history.

(56) References Cited

U.S. PATENT DOCUMENTS 965,131 A * 7/1910 Bliss ..... 279/89
1,902,941 A * 3/1933 Bailey ..... 175/340

(Continued)

FOREIGN PATENT DOCUMENTS

JP 05-065787 A 3/1993

(Continued)

OTHER PUBLICATIONS

International Search Report dated Oct. 28, 2008, issued on PCT/JP2008/063499.

*Primary Examiner* — Daniel P Stephenson
(74) *Attorney, Agent, or Firm* — Edwards Wildman Palmer LLP

(57) ABSTRACT

Provided is an excavation tool which can firmly fix a locking pin so that the locking pin does not move even in the case of an impact during excavation and/or the locking pin being pushed out in the insertion/removal direction.

The excavation tool (10) includes a tool body (20) having an attaching hole (32) and an attaching member (40).

The attaching member (40) is provided with an attaching shaft (45) inserted into the attaching hole (32), and the outer peripheral surface of the attaching shaft (45) is provided with a groove (46) which crosses the extension direction of the attaching shaft (45).

The tool body (40) is provided with a pin hole (33) extending in a direction crossing the extension direction of the attaching hole (32). A part of the pin hole (33) passes through the attaching hole (32).

A locking pin (56), which can engage with the groove (46) of the attaching shaft (45) inserted into the attaching hole (32), is inserted into the pin hole (33). An opening of the pin hole (33) is provided with a fixing member (50) which is a rigid body and abuts on the end face of the locking pin (56) to fix the locking pin, and a locking portion (57) which locks the fixing member (50) in the extension direction of the pin hole (33) to fix the fixing member.

12 Claims, 16 Drawing Sheets

U.S. PATENT DOCUMENTS

| | | | | | |
|---|---|---|---|---|---|
| 3,652,130 | A | * | 3/1972 | Elders | 299/106 |
| 3,796,464 | A | * | 3/1974 | Hansen et al. | 299/104 |
| 4,212,559 | A | * | 7/1980 | Persson | 403/348 |
| 4,282,665 | A | * | 8/1981 | Fletcher et al. | 37/457 |
| 4,607,891 | A | * | 8/1986 | Pendolino et al. | 299/108 |
| 4,679,858 | A | * | 7/1987 | Tank | 299/113 |
| 4,776,639 | A | * | 10/1988 | Braun et al. | 299/108 |
| 4,913,125 | A | * | 4/1990 | Bunting et al. | 125/43 |
| 7,393,061 | B2 | * | 7/2008 | Hesse et al. | 299/112 R |

FOREIGN PATENT DOCUMENTS

| | | | |
|---|---|---|---|
| JP | 06-074222 | A | 3/1994 |
| JP | 08-295268 | A | 11/1996 |
| JP | 08-295269 | A | 11/1996 |
| JP | 10-184260 | A | 7/1998 |
| JP | 2004-211492 | A | 7/2004 |
| JP | 2006-283516 | A | 10/2006 |

* cited by examiner

[Fig. 1]
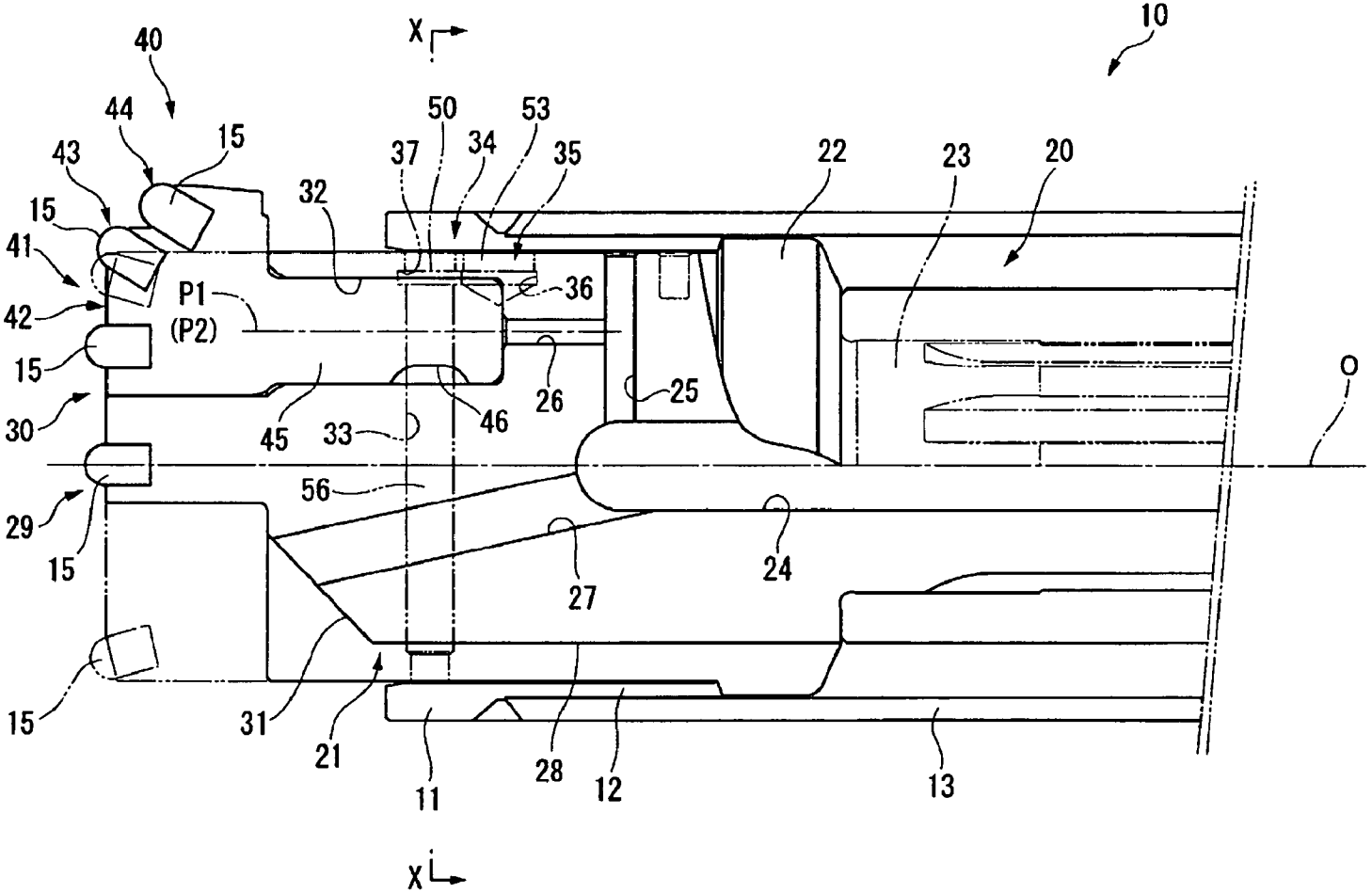

[Fig. 2]
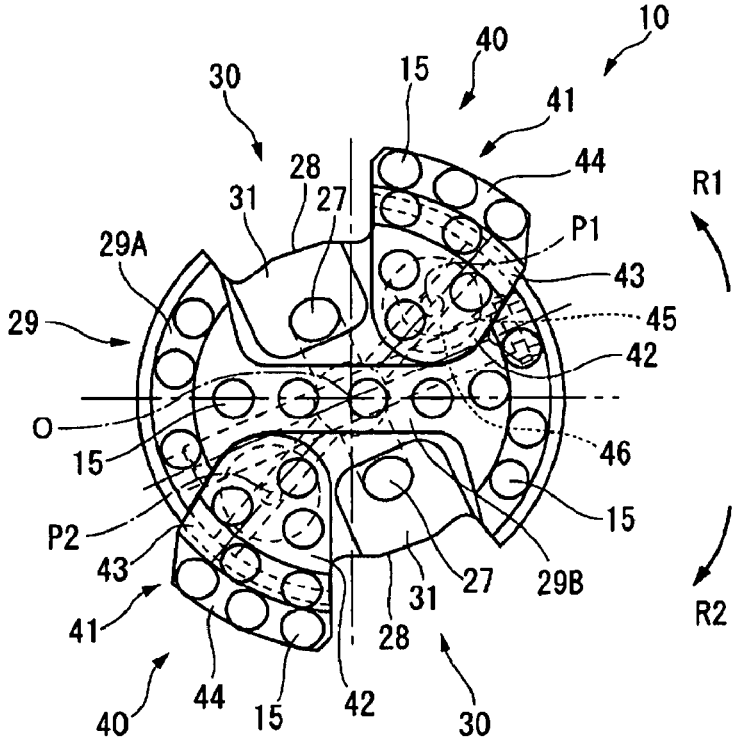
[Fig. 3]
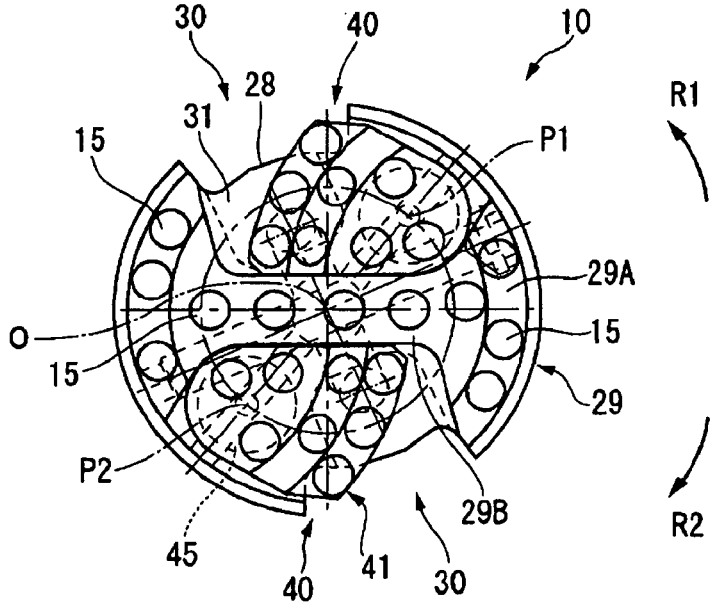

[Fig. 4]
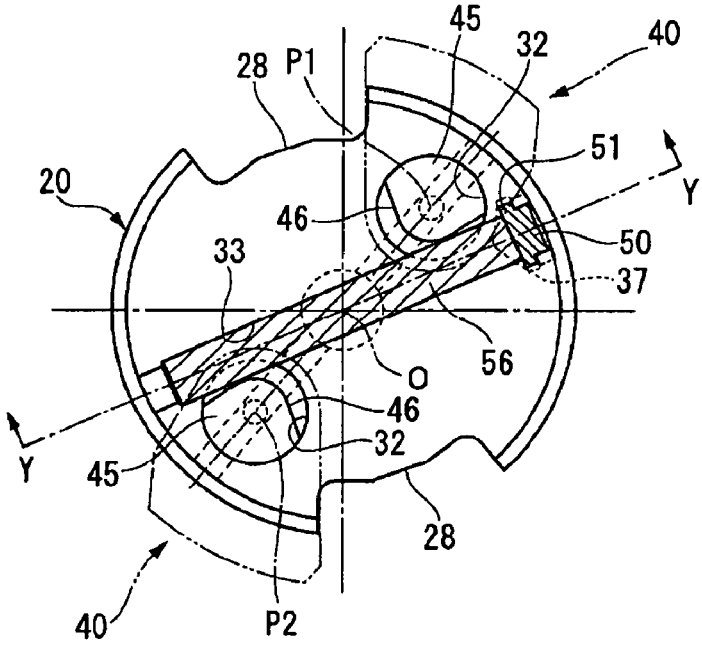
[Fig. 5]
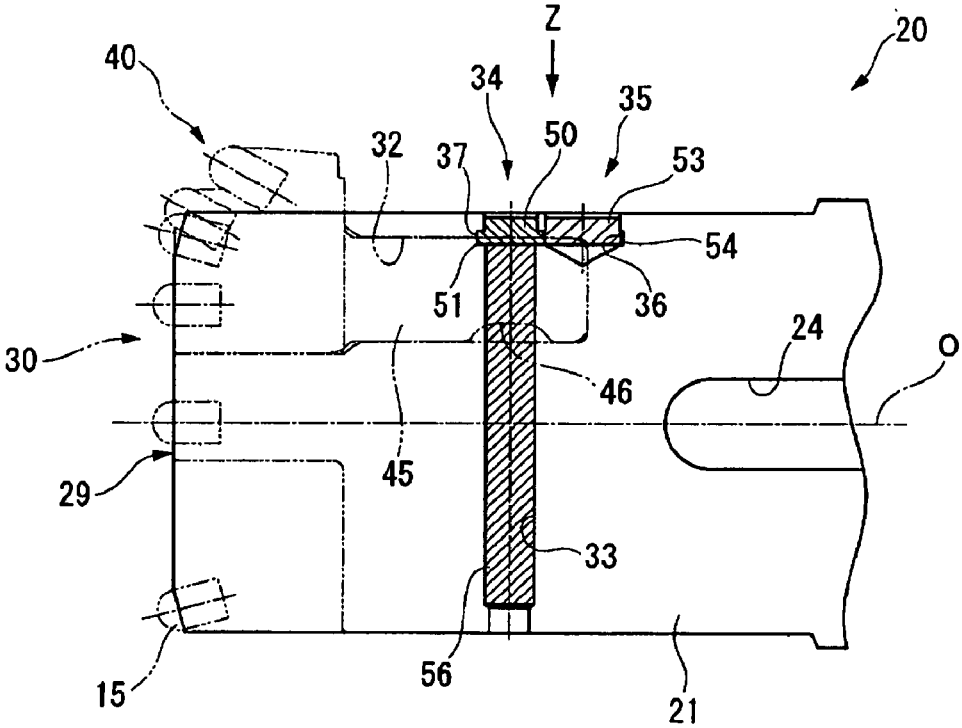

[Fig. 6]
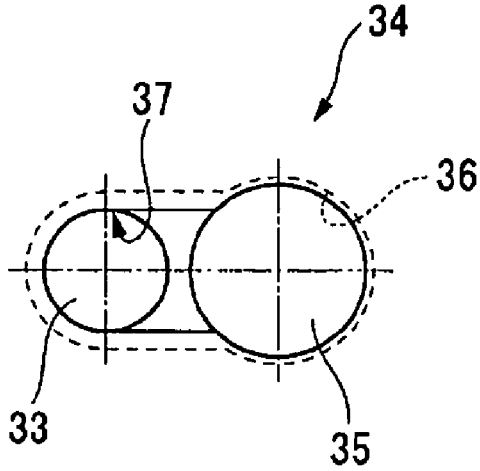
[Fig. 7]
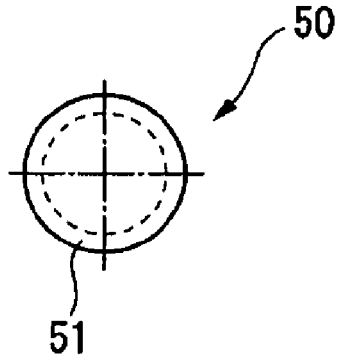
[Fig. 8]
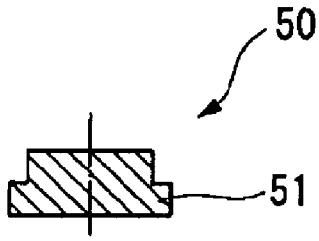

[Fig. 9]
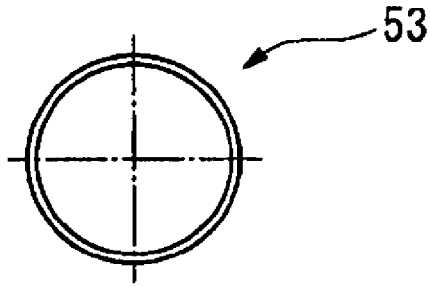
[Fig. 10]
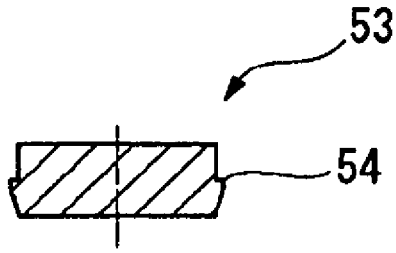

[Fig. 11]
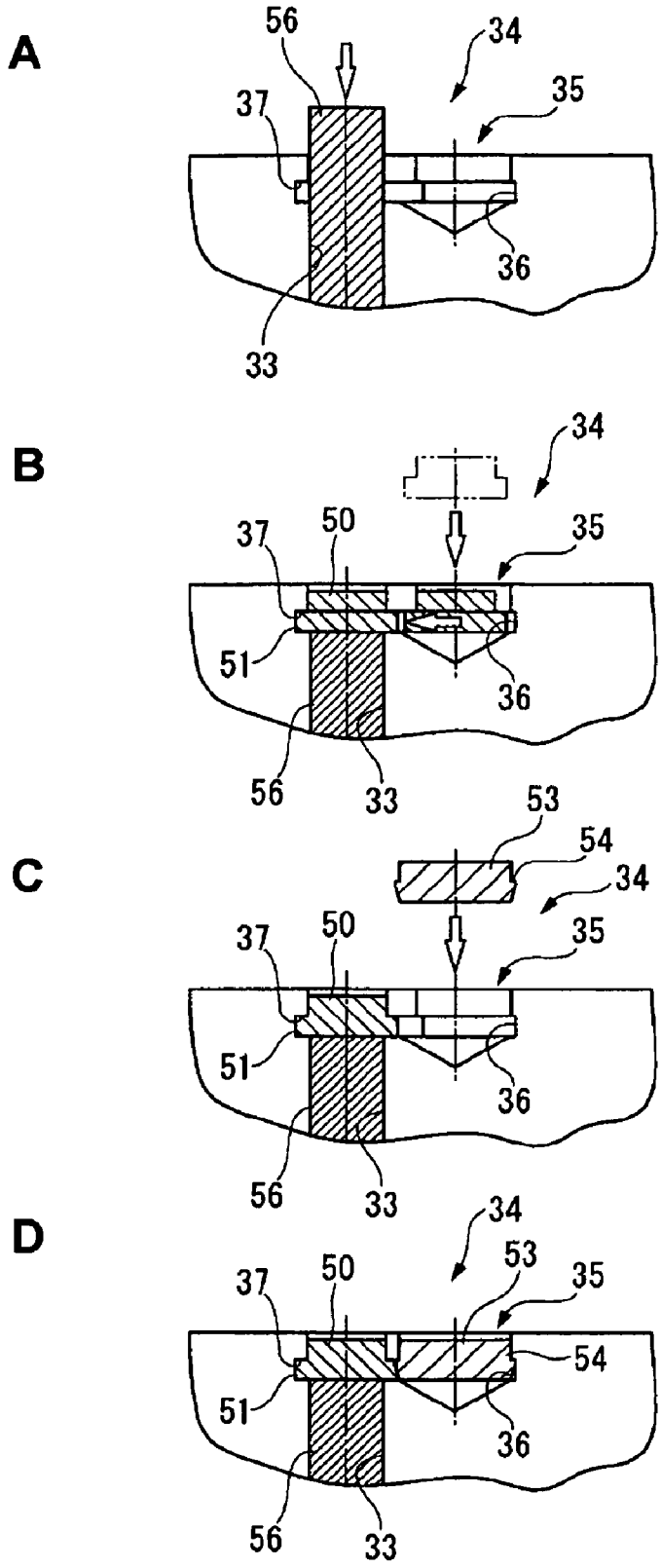

[Fig.12]
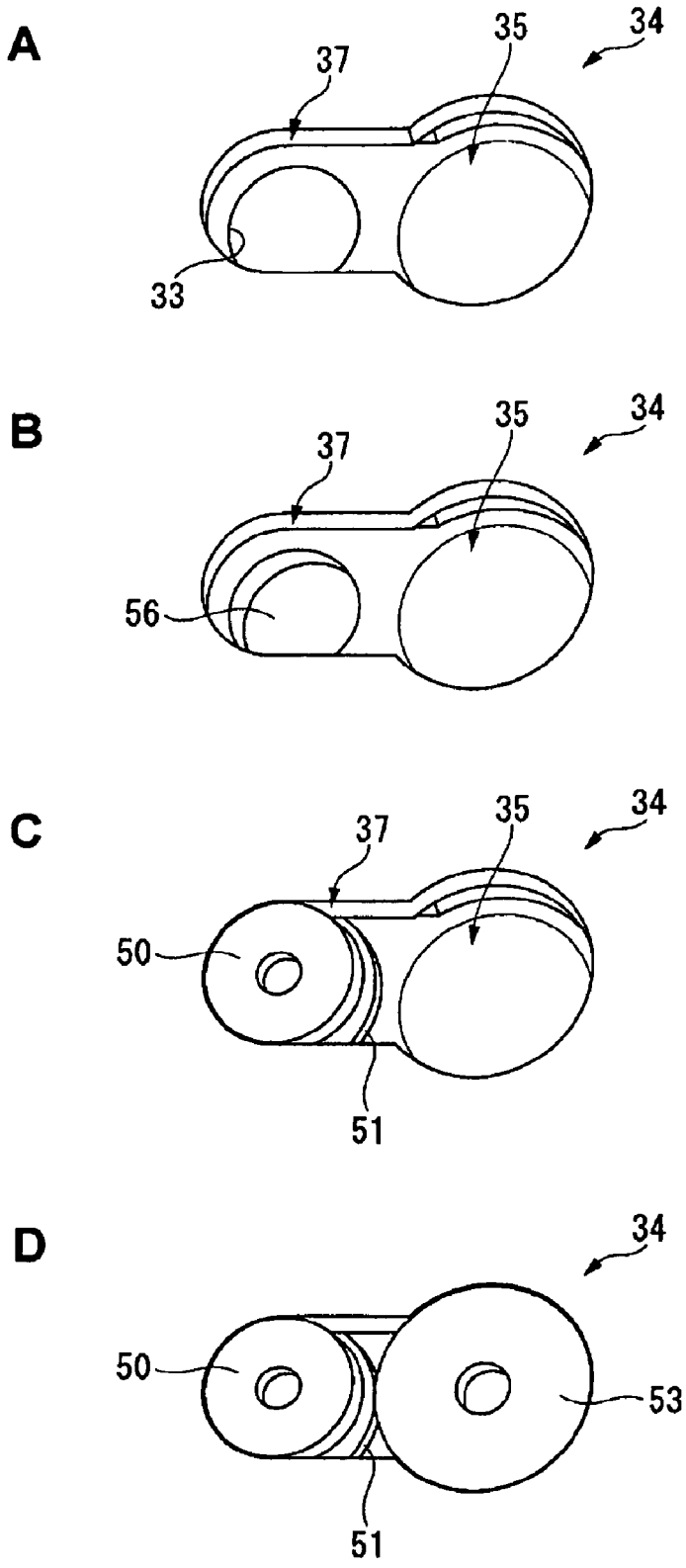

[Fig. 13]
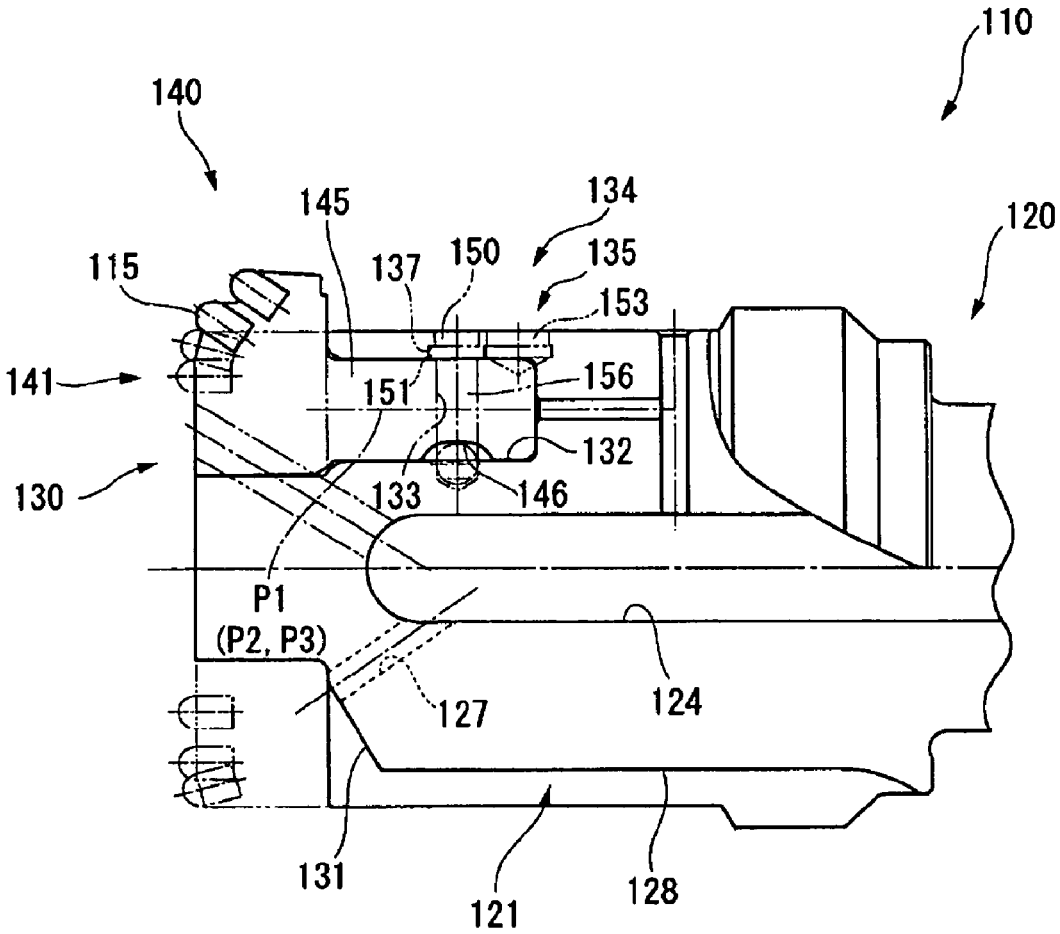

[Fig. 14]
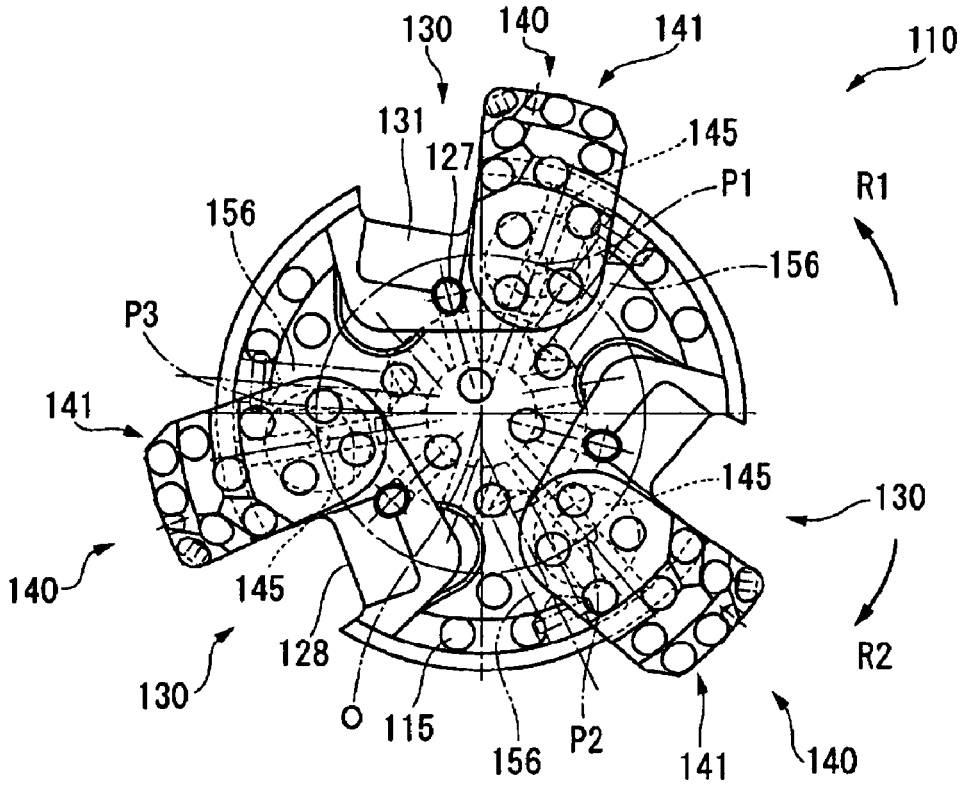

[Fig. 15]
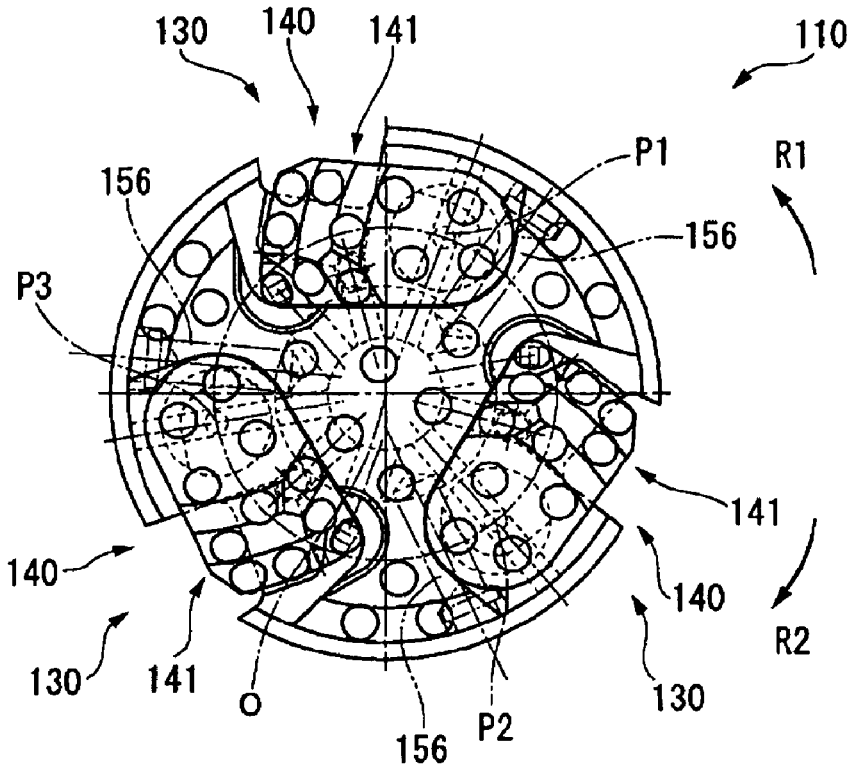

[Fig. 16]
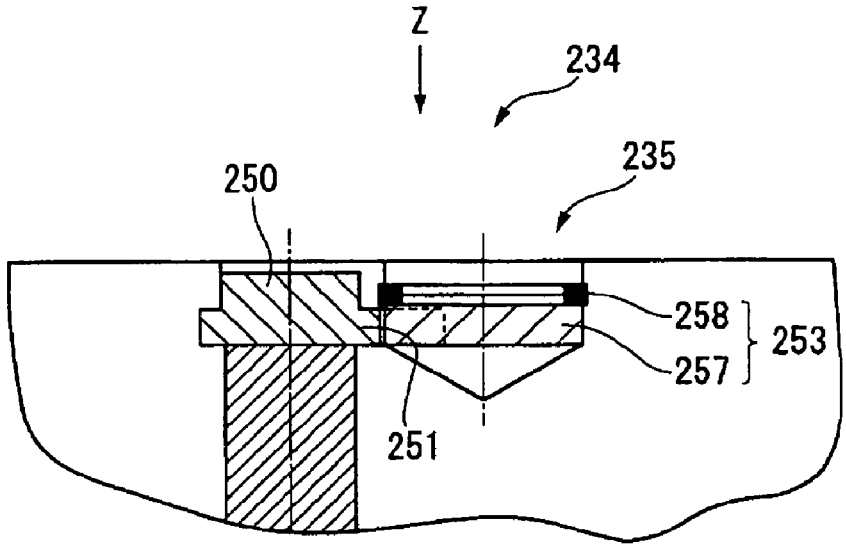
[Fig. 17]
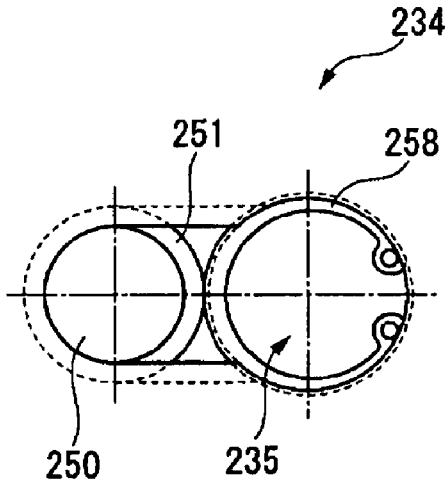

[Fig. 18]
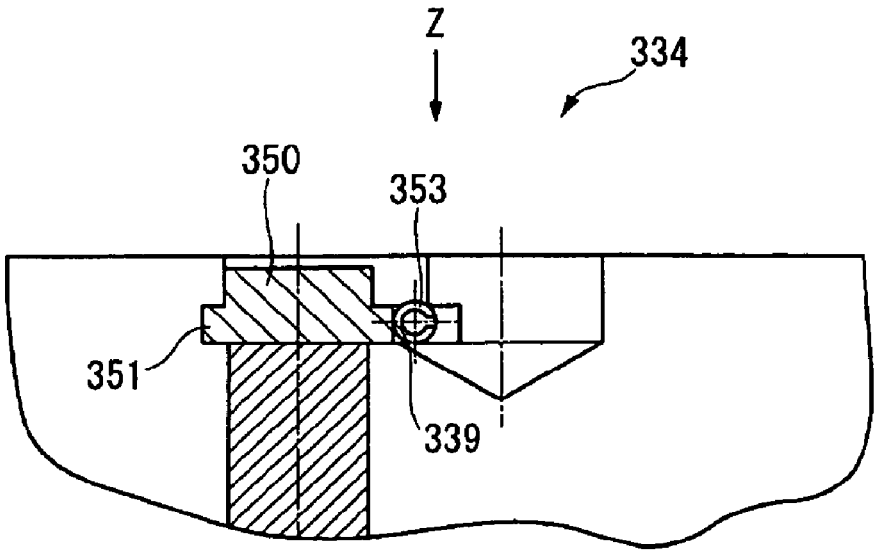
[Fig. 19]
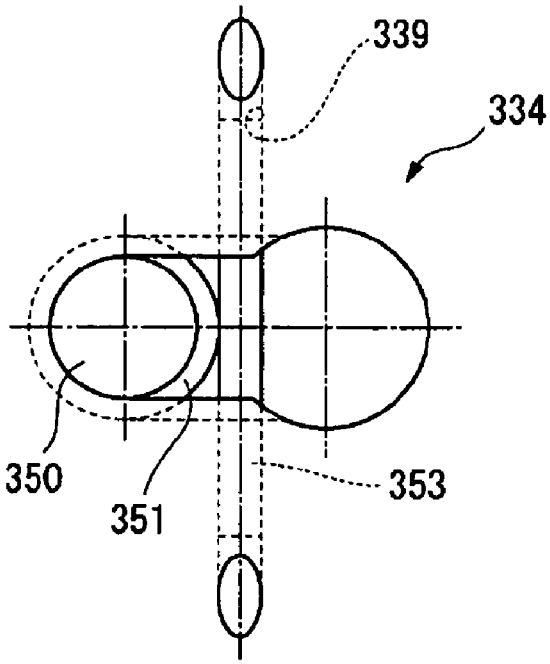

[Fig. 20]
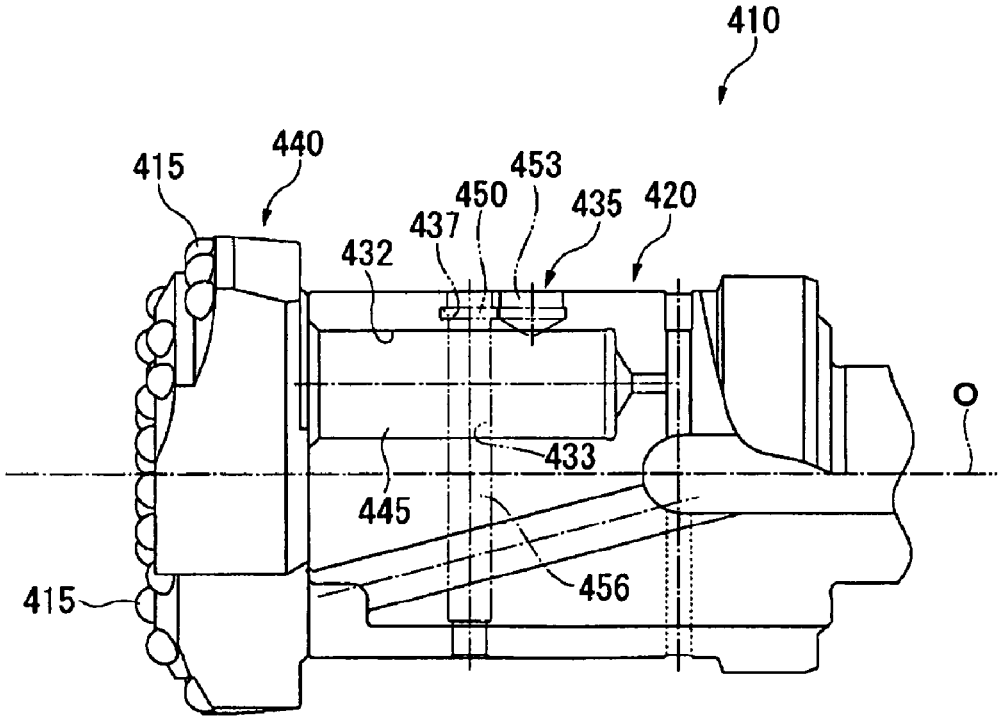
[Fig. 21]
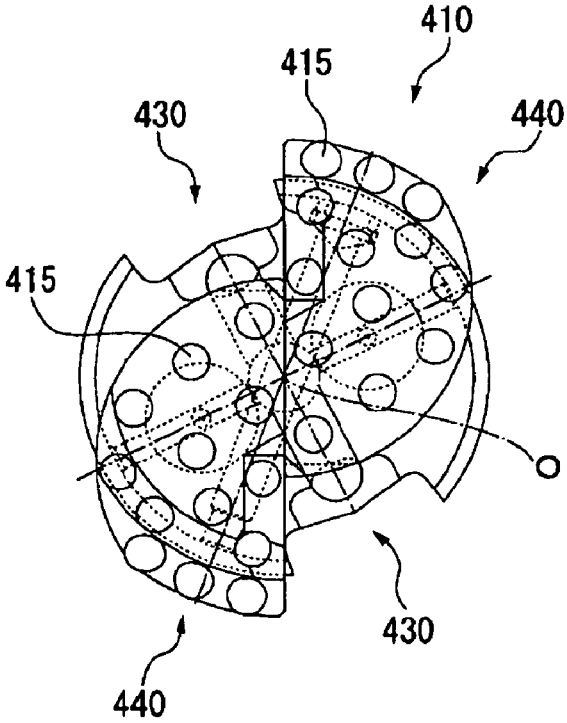

[Fig. 22]
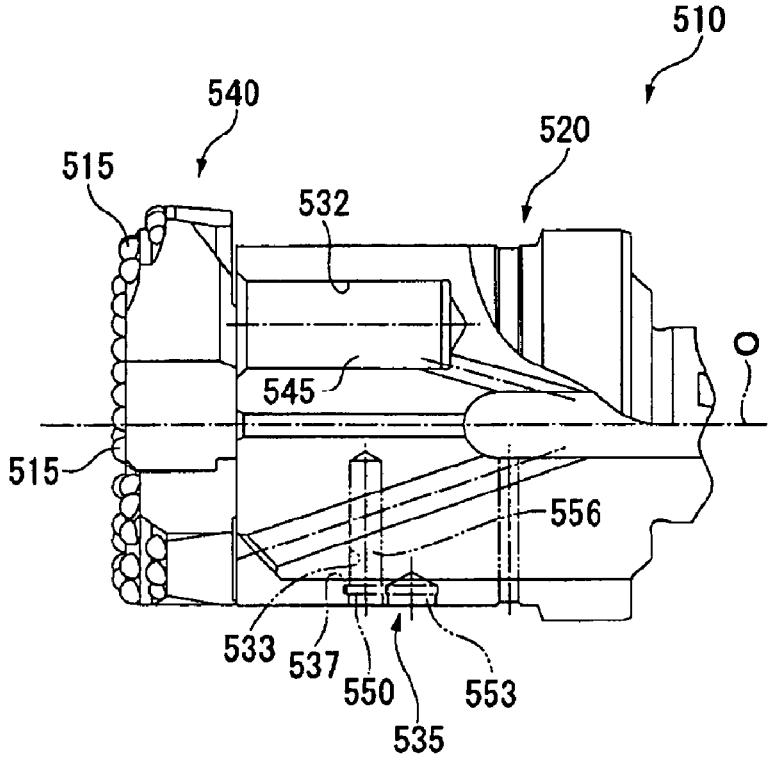
[Fig. 23]
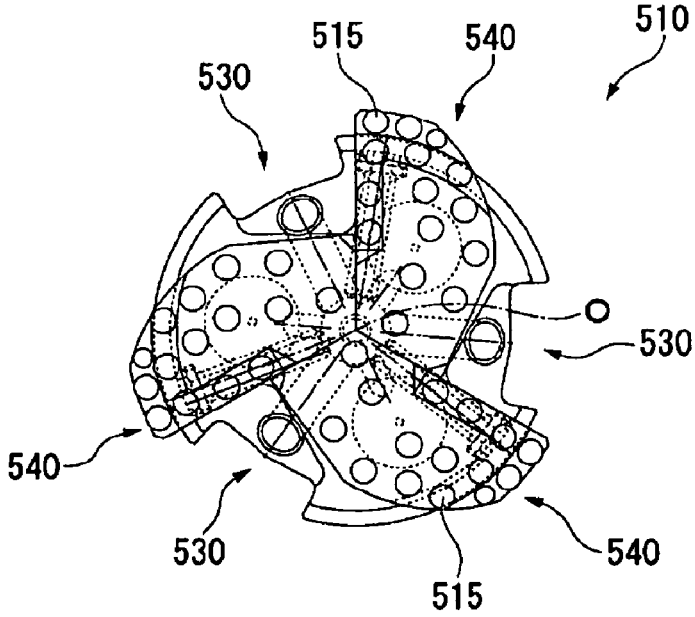

[Fig. 24]
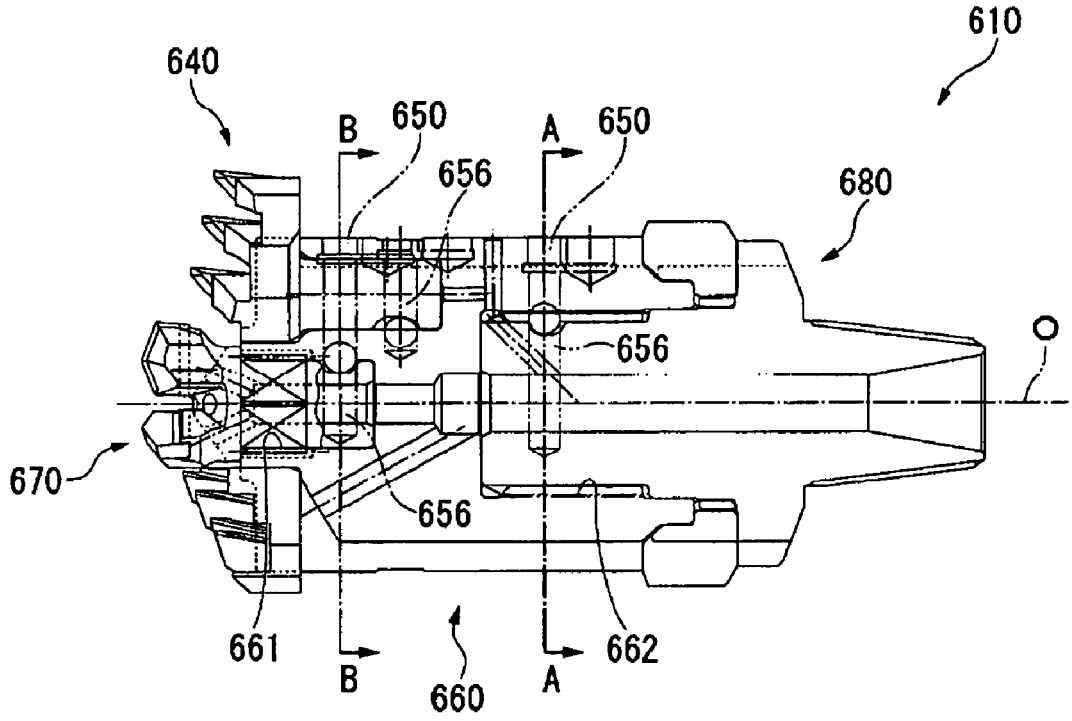

[Fig. 25]
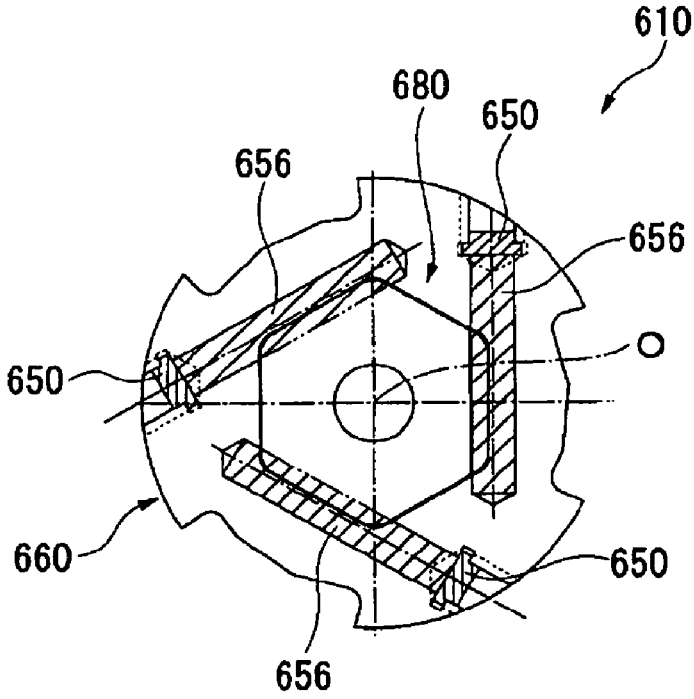
[Fig. 26]
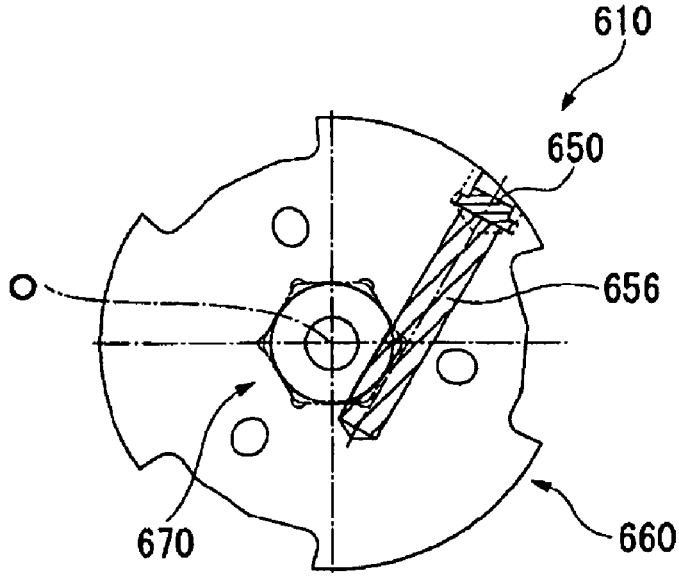

EXCAVATION TOOL

TECHNICAL FIELD

The present invention relates to an excavation tool used for excavating the ground and/or soil; in works, for example, various anchor constructions, various well drilling constructions, and/or various foundation constructions.

BACKGROUND ART

Generally, as excavation tools which excavate a ground, the ground, and/or soil, a so-called diameter-enlarged type excavation tool (for example, refer to Patent Document 1) is provided.

This tool includes a device which rotates on a central axis and a bit head, namely, bit wing, rotatable on a rotational axis eccentric from the central axis.

Also, this tool has a structure in which the bit head protrudes radially outward when the device is rotating in one direction, and the bit head retracts radially inward when the device is rotating in the other direction.

Specifically, an attaching hole which is open into the tip face of the device and extends parallel to the central axis, is bored in a position eccentric from the central axis.

A pin hole; which is open into the outer peripheral surface of the device, and passes through a part of the inner peripheral surface of the attaching hole; is formed in the attaching hole.

A locking pin is embedded in the pin hole.

The bit head includes

- a bit excavating portion to which a tip made of a hard material, such as a cemented carbide, is fixed, and
- an attaching shaft which is integrally connected to the bit excavating portion and is inserted into the attaching hole.

A groove for engaging with the locking pin is formed in the outer peripheral surface of the attaching shaft.

The attaching shaft of the bit head is inserted into the attaching hole of the device, and also the locking pin is inserted into the pin hole from the outer peripheral surface of the device. Thus, the locking pin and the groove of the attaching shaft are engaged with each other.

Therefore, the bit head is retained at the tip of the rotational axis.

Additionally, the bit head has a structure; in which, when the bottom surface in the groove and the outer peripheral surface of the locking pin slide along each other, this sliding movement can make the bit head rotate on the axis of the attaching hole (and attaching shaft) as its rotational axis.

In such an excavation tool, when excavation is performed, the device is rotated in one direction (forward direction). This rotation generates a force of friction among the device, the bit head, an object to be excavated (a mountain, the ground, etc.) and/or a casing top, namely, casing shoe. Also, the force of friction makes the bit head protrude radially outward, and then an excavated hole can be formed.

After the formation of the excavated hole has been completed, the device is rotated in the other direction (backward direction). This rotation generates a force of friction with the object to be excavated and/or a casing top. Also, the force of friction makes the bit head retract radially inward, and then the excavation tool can be withdrawn through the excavated hole.

If the locking pin comes off during an excavation work, the bit head may detach from the device and may remain inside the excavated hole; and then the excavating work will be suspended or stopped. Or a further excavation work is required to be performed again. Accordingly, it is necessary to provide a retaining means so that the locking pin does not come off from the device. As such a retaining means for the locking pin, for example, the use of an elastic member has been suggested as disclosed in Patent Documents 2 to 4.

[Patent Document 1] Japanese Unexamined Patent Application No. H05-065787

[Patent Document 2] Japanese Unexamined Patent Application No. H06-074222

[Patent Document 3] Japanese Unexamined Patent Application No. H08-295268

[Patent Document 4] Japanese Unexamined Patent Application No. H08-295269

DISCLOSURE OF THE INVENTION

Problems that the Invention is to Solve

Meanwhile, in a case where the retaining means disclosed in Patent Documents 2 to 4 is adapted for the locking pin provided in the aforementioned excavation tool, since the locking pin presses the elastic member to elastically deform the elastic member due to an impact or repulsion during excavation, there is a possibility that the locking pin may not be firmly fixed.

Additionally, if the attaching shaft of the bit head and the locking pin come into contact with each other when the bit head has been rotated on the rotational axis, there is a problem in that the locking pin is pushed out in the insertion/removal direction.

The invention was made in view of the aforementioned situation, and the object thereof is to provide an excavation tool which can firmly fix a locking pin so that the locking pin does not move even in the case of an impact during excavation and/or the locking pin being pushed out in the insertion/removal direction.

Means for Solving the Problems

In order to solve such a problem and achieve the above object, an excavation tool of the invention includes

- a tool body mounted on a tip of an excavation machine and having an attaching hole, and
- an attaching member detachably mounted on the tool body.

The attaching member is provided with an attaching shaft inserted into the attaching hole.

A groove, which crosses the extension direction of the attaching shaft, is formed in the outer peripheral surface of the attaching shaft.

A pin hole, which extends in a direction crossing the extension direction of the attaching hole, is formed in the tool body.

A part of the pin hole passes through the attaching hole.

A locking pin, which can engage with the groove of the attaching shaft inserted into the attaching hole, is inserted into the pin hole.

An opening of the pin hole is provided with

- a fixing member which is a rigid body and abuts on the end face of the locking pin to fix the locking pin, and
- a locking portion which locks the fixing member in the extension direction of the pin hole to fix the fixing member.

In the excavation tool of this construction, the fixing member which is made of a rigid body, and abuts on the end face of the locking pin to fix the locking pin; is embedded in the opening of the pin hole formed in the tool body. Thus, it is possible to firmly fix the locking pin without a large elastic deformation of the fixing member caused by an impact or the like during excavation.

Additionally, since the locking portion which locks and fixes the fixing member in the extension direction of the pin hole (the insertion/removal direction of the locking pin) is provided, the locking pin is prevented from moving in the insertion/removal direction of the locking pin, so that the coming-off of the locking pin can be reliably prevented.

Here, an auxiliary member, which maintains an engagement state between the fixing member and the locking portion, may be embedded in the tool body.

In this case, since the engagement state between the fixing member and the locking portion is maintained by the auxiliary member, the fixing member can be prevented from coming out of the locking portion due to an impact or the like during excavation, and the coming-off of the locking pin can be reliably prevented.

Additionally, the auxiliary member may be made of an elastic material.

In this case, the engagement state between the fixing member and the locking portion can be maintained by using the elastic force of the elastic material, and the moving of the fixing member can be prevented. In addition, since the locking pin does not directly contact with the auxiliary member made of the elastic material, the locking pin can be firmly fixed without any elastic deformation of the auxiliary member caused by the pressing force from the locking pin.

Moreover, the tool body: wherein a sliding groove, along which the fixing member slidingly moves, is provided;

the pin hole is open into one end of the sliding groove together with the locking portion formed therein; and a loading portion of the fixing member is provided at the other end of the sliding groove; is useable.

In this case, the fixing member is loaded into the sliding groove from the loading portion provided at the other end side of the sliding groove. By moving the fixing member towards one end of the sliding groove, the fixing member can be embedded in the opening of the pin hole. Thus, the locking portion can lock and fix the fixing member. Consequently, the fixing member can be embedded by a simple operation to firmly fix the locking pin.

Additionally, the tool body may be used as a device which is rotatable on a central axis, and the attaching hole may be formed so as to be open into the tip of the device.

The attaching member may be used as a bit head having a bit excavating portion to which a tip made of a hard material is fixed, the attaching shaft may be integrally connected to the bit excavating portion.

The outer peripheral surface of the attaching shaft may be provided with a groove which crosses the extension direction of the attaching shaft and also extends in a peripheral direction.

When the device rotates in one direction, the bit head may rotate on the rotational axis, and the bit head also may protrude outward; and when the device rotates in the other direction, the bit head may rotate on the rotational axis, and the bit head also may retract inward.

In this case, in a so-called diameter-enlarged type excavation tool, it is possible to firmly fix the locking pin which locks the bit head.

Advantage of the Invention

According to the invention; an excavation tool, which can firmly fix the locking pin so that the locking pin does not move, can be provided; even in the case of an impact during excavation and/or the locking pin being pushed out in the insertion/removal direction.

BRIEF DESCRIPTION OF THE DRAWINGS

FIG. 1 is a partial side sectional view of an excavation tool that is a first embodiment of the invention.

FIG. 2 is a front view showing a diameter-enlarged state of the excavation tool shown in FIG. 1.

FIG. 3 is a front view showing a diameter-reduced state of the excavation tool shown in FIG. 1.

FIG. 4 is a sectional view taken along a line X-X in FIG. 1.

FIG. 5 is a sectional view taken along a line Y-Y of FIG. 4.

FIG. 6 is a view as seen in a direction Z in FIG. 5.

FIG. 7 is a top view of a fixing member provided in the excavation tool shown in FIG. 1.

FIG. 8 is a side sectional view of the fixing member shown in FIG. 7.

FIG. 9 is a top view of an auxiliary member provided in the excavation tool shown in FIG. 1.

FIG. 10 is a side sectional view of the auxiliary member shown in FIG. 9.

FIG. 11 is an explanatory view showing a method of fixing a locking pin in the excavation tool shown in FIG. 1.

FIG. 12 is an explanatory view showing the method of fixing the locking pin in the excavation tool shown in FIG. 1.

FIG. 13 is a partial side sectional view of an excavation tool that is a second embodiment of the invention.

FIG. 14 is a front view showing a diameter-enlarged state of the excavation tool shown in FIG. 13.

FIG. 15 is a front view showing a diameter-reduced state of the excavation tool shown in FIG. 13.

FIG. 16 is an explanatory view showing another example of the auxiliary member.

FIG. 17 is a view as seen in a direction Z in FIG. 16.

FIG. 18 is an explanatory view showing still another example of the auxiliary member.

FIG. 19 is a view as seen in a direction Z in FIG. 18.

FIG. 20 is a partial side sectional view of an excavation tool that is a still further embodiment of the invention.

FIG. 21 is a front view showing a diameter-enlarged state of the excavation tool shown in FIG. 20.

FIG. 22 is a partial side sectional view of an excavation tool that is a still further embodiment of the invention.

FIG. 23 is a front view, showing a diameter-enlarged state of the excavation tool shown in FIG. 22.

FIG. 24 is a partial side sectional view of an excavation tool that is a still further embodiment of the invention.

FIG. 25 is a sectional view taken along a line A-A in FIG. 24.

FIG. 26 is a sectional view taken along a line B-B in FIG. 24.

DESCRIPTION OF REFERENCE NUMERALS AND SIGNS

10, 110, 410, 510, 610: Excavation Tool
20, 120: Device (Tool Body)
32, 132, 432, 532, 661, 662: Attaching Hole
33, 133: Pin Hole
34, 134, 234, 334: Sliding Groove
35, 135, 35: Loading Recess (Loading Portion)
37, 137: Locking Groove (Locking Portion)
40, 140, 440, 540, 640: Bit Head (Attaching Member)
41, 141: Bit Excavating Portion
45, 145: Attaching Shaft

46, 146: Groove
50, 150, 250, 350, 450, 550, 650: Fixing Member
53, 153, 253, 353: Auxiliary Member
56, 156, 456, 556, 656: Locking Pin
660: Tool Body

BEST MODE FOR CARRYING OUT THE INVENTION

An excavation tool that is a first embodiment of the invention will be described below in reference to the accompanying drawings.

The excavation tool 10, as shown in FIG. 1, includes

- a device 20 shaped substantially in cylindrical tears extends along a central axis O,
- a bit head 40 detachably mounted on the tip (the left in FIGS. 1 and 5) of the device 20,
- a casing top 11 fitted to an outer peripheral portion of the device 20, and
- a casing pipe 13 connected to the rear end of the casing top 11.

The casing top 11

- is substantially cylindrical,
- has a structure able to fit to an outer peripheral portion of the device 20, and
- is able to receive a driving force from the strike of the device 20.

A rear end of the casing top 11

- has an external diameter which is one-tier smaller than that of the other portions, and
- is used as a connecting portion 12 of the casing pipe 13.

The casing pipe 13

- is cylindrical,
- has an external diameter made equal to that of the casing top 11, and
- has an internal diameter approximately equal to the external diameter of the connecting portion 12 of the casing top 11.

The casing pipe 13 has a tip welded to the casing top 11 in a state where the casing pipe is fitted to the connecting portion 12 of the casing top 11.

The device 20 has

- a device body 21 located at the tip,
- a large diameter portion 22 which is integrally connected to the rear end of the device body 21 and has a diameter extended radially outward, and
- a small diameter portion 23 which is integrally connected to the rear end of the large diameter portion 22 and has a diameter sufficiently reduced radially inward.

In addition, the device body 21, the large diameter portion 22, and the small diameter portion 23 are integrally formed.

The small diameter portion 23 is connected to a striking power transmission mechanism (air hammer) not shown in Figs, and has a structure rotatable by a rotational driving mechanism not shown in Figs, too. The device 20 is rotatable on the central axis O, and receives striking power in the direction of the central axis O.

The external diameter of the large diameter portion 22 is set for approximately equal to the internal diameter of the casing pipe 13.

Additionally, the casing top 11 is fitted to the outer peripheral side of the device body 21; and a tip face of the large diameter portion 22 abuts on the rear end face of the casing top 11.

Thus, the casing top 11 has a structure in which the striking power can be received and can be transmitted as a driving force through the large diameter portion 22.

Additionally, a fluid supply passage 24 which; extends along the center axis O, goes to the device body 21, and is open into the rear end face of the small diameter portion 23; is provided inside the device 20.

A connecting passage 25, which extends towards a direction (radially outward) perpendicular to the center axis O, is connected to a tip portion of the fluid supply passage 24. Also, a communicating hole 26; which extends parallel to the center axis O from the connecting passage 25, and is open into the bottom surface of the attaching hole 32 which will be described later; is provided. The attaching hole 32 which will be described later.

Moreover, a fluid discharge hole 27, which gradually goes radially outward in the direction of the tip, is connected to the tip portion of the fluid supply passage 24.

The tip face of the device body 21 is provided with a housing recess 30, which is concave radially inward and toward the rear end.

In this embodiment, FIGS. 2 and 3, in the views of the tip face, show that two housing recesses 30 are provided so as to be point-symmetrical with respect to the central axis O.

Thereby the portion of the tip face of the device body 21 except the housing recess 30, is substantially H-shaped in the view from the tip face, and protrudes towards the tip.

A plurality of tips 15 made of a hard material, such as cemented carbide, is implanted in the substantially H-shaped portion, and is used as a device excavating portion 29 which excavates an object to be excavated.

Specifically, the device excavating portion 29 includes

- a pair of outer peripheral excavating portions 29A which extends along the outer peripheral surface of the device body 21, and
- a central excavating portion 29B which passes through the central axis O and is connected to the pair of outer peripheral excavating portions 29A.

The central excavating portion 29B extends so as to be perpendicular to the central axis O, and five tips 15 are arranged so that the radial distances of the respective tips 15 from the central axis O are different from each other.

Additionally, the outer peripheral excavating portion 29A slightly inclines with respect to the central excavating portion 29B so as to gradually retract radially outward in accordance with the direction of the rear end, and six tips 15 are arranged along the peripheral direction.

Additionally, an inclined surface portion 31 is formed at a forward portion in a rotational direction R1 on the inner surface facing to the tip of the housing recess 30. The inclined surface portion 31 gradually retracts radially outward in the direction of the rear end. The aforementioned fluid discharge hole 27 is open into the inclined surface portion 31.

Additionally, as shown in FIGS. 1 to 3, a cutout groove 28 is formed on a side surface of the device 20 which is integrally connected to a radial outer end of the inclined surface portion 31. The cutout groove 28 is concave with one-tier radially inward, and also extends parallel to the central axis O.

Two attaching holes 32 are formed respectively at backward portions in the rotational direction R1 on the inner surface facing to the tip of the housing recess 30. The attaching holes 32 are eccentric from the central axis O, and also are point-symmetrical with respect to the central axis O as shown in FIGS. 2 and 3. Further the attaching holes 32 extends along two rotational axes P1 and/or P2, which also extends parallel to the central axis O as shown in FIG. 1.

Additionally, a pin hole 33; which

- extends in a direction perpendicular to the central axis O and the rotational axes P1 and/or P2, and
- passes through the two attaching holes 32;

is formed in the device body 21.

The pin hole 33 is provided so as to pass through the central axis O and portions of the inner peripheral surfaces of the two attaching holes 32, as shown in FIG. 4, in a cross-section perpendicular to the central axis O.

That is, the pin hole 33 has a construction so as to extend in the radial direction of the device 20.

One end (lower side in FIGS. 1 and 5) of the pin hole 33 is a tier portion having a smaller diameter than that of the other portions. Additionally, as shown in FIGS. 1 and 5, a sliding groove 34 is formed at an opening in the other end of the pin hole 33 (upper side in FIGS. 1 and 5). The sliding groove 34 extends in a direction perpendicular to the extension direction of the pin hole 33 (which extends parallel to the central axis O).

A loading recess 35; which is open into the outer peripheral surface of the device body 21, and has a circular shape in a cross sectional view; is formed at the rear end of the sliding groove 34 in the direction of the central axis O. A ring-shaped groove 36 is formed between the bottom portion and inner peripheral surface of the loading recess 35.

Additionally, the tip of the loading recess 35 in the direction of the central axis O is provided with a locking groove 37 which extends with a width smaller than the diameter of the loading recess 35.

In this embodiment, as shown in FIG. 6, the locking groove 37 has a U shape, and is open towards the loading recess 35.

An opening of the pin hole 33 is embedded in the tip of the sliding groove 34 in the central axis O.

Next, the bit head 40 will be described.

As shown in FIGS. 1 to 3, the bit head 40 includes

- a bit excavating portion 41, in which a plurality of tips 15 made of a hard material, such as a cemented carbide, is implanted, and
- a substantially cylindrical attaching shaft 45 which extends towards the rear end of the bit excavating portion 41.

The bit excavating portion 41 includes

- a flat surface portion 42 which is integrally connected to the tip of the attaching shaft 45, and extends in a direction perpendicular to the axis of the attaching shaft 45;
- a tapered portion 43 which is integrally connected to the flat surface portion 42; and
- a tier portion 44 which retreats into one-tier towards the rear end from the tapered portion 43.

In addition, in this embodiment, as shown in FIG. 2 and FIG. 3, three tips 15 are implanted in the flat surface portion 42; two tips 15 are implanted in the tapered portion 43; and three tips 15 are implanted in one row into the tier portion 44.

The attaching shaft 45 has a structure of fitting into the attaching hole 32 which is open into the tip face of the device 20; and also the axis of the attaching shaft 45 is same as the rotational axes P1 and/or P2.

A groove 46; which is perpendicular to the axis (the rotational axes P1 and/or P2), and extends along the peripheral surface of the attaching shaft 45; is formed at the attaching shaft 45.

In this embodiment, as shown in FIGS. 2 to 4, the groove 46 is formed in a portion of the outer peripheral surface of the attaching shaft 45, and is L-shaped as seen from the direction of the axis (the rotational axes P1 and/or P2) of the attaching shaft 45.

In addition, the groove 46 is formed on the side opposite to the side where the tapered portion 43 and the tier portion 44 of the bit excavating portion 41 are provided, as a view from the direction of the axis (the rotational axes P1 and/or P2) of the attaching shaft 45.

Next, a fixing member 50 embedded in the sliding groove 34, and an auxiliary member 53 will be described. As shown in FIGS. 7 and 8, the fixing member 50 is formed in the shape of a disk including a flange portion 51. The fixing member 50 is composed of a rigid body made of steel or the like so as not to elastically deform easily. The external diameter of the flange portion 51 is set to be smaller than the diameter of the loading recess 35 of the sliding groove 34, and also is set to be larger than the width of the locking groove 37.

The auxiliary member 53, as shown in FIGS. 9 and 10, is substantially disk-shaped, and is made of an elastic member, such as a synthetic rubber. On one end of the auxiliary member 53 is formed a claw 54 which is formed in a tapered shape and protrudes radially outward.

Next, a method of connecting the bit head 40 and the device 20 will be described in reference to FIGS. 11 and 12.

First, the attaching shaft 45 of the bit head 40 is inserted into the attaching hole 32 which is open into the tip face of the device 20.

At this time, the bit head 40 is arranged that the portion of the pin hole 33 and the groove 46 face each other. The pin hole 33 passes through a portion of the attaching hole 32, and the groove 46 is formed in the outer peripheral surface of the attaching shaft 45.

In this state, inserting the cylindrical locking pin 56 into the pin hole 33 which is open into the sliding groove 34 (FIGS. 11A and 12B); the locking pin 56 becomes perpendicular to the central axis O, and also passes through the two attaching holes 32.

The fixing member 50 is loaded into the sliding groove 34 from the loading recess 35 of the sliding groove 34 so that the flange portion 51 faces radially inward. Then the fixing member 50 is slidingly moved into the locking groove 37 (FIGS. 11B and 12C). In this way, the fixing member 50 abuts on the end face of the locking pin 56, and the flange portion 51 is engaged with the locking groove 37 in the extension direction of the pin hole 33. Whereby, the fixing member 50 is fixed.

Then, the auxiliary member 53, which is elastically deformable, is press-fitted into the loading recess 35 (FIGS. 11C and 11D, and 12D).

At this time, the claw 54 provided in the auxiliary member 53 is engaged with the ring-shaped groove 36 formed in the inner peripheral surface of the loading recess 35; whereby the auxiliary member 53 is fixed.

Additionally, since the outer peripheral surface of the auxiliary member 53 presses the outer peripheral surface of the fixing member 50, this pressure prevents the fixing member 50 from moving within the sliding groove 34.

In this way, the device 20 and the bit head 40 are connected with each other. Since the groove 46 formed in the outer peripheral surface of the attaching shaft 45 is locked to the locking pin 56, the bit head 40 is retained at the tip in the direction of the rotational axes P1 and/or P2.

In the excavation tool 10 constructed in this way;

rotating the device 20 in the rotational direction R1 shown in FIGS. 2 and 3 by a rotational driving means, the force of the friction with the object to be excavated and/or the casing top makes the bit head 40 rotate on the rotational axes P1 and/or P2, and then the tapered portion 43 and the tier portion 44 of the bit head 40 protrude radially outward.

On the other hand, when rotating the device 20 in the rotational direction R2 shown in FIGS. 2 and 3 by a rotational driving means, the force of the friction with the object to be excavated and/or the casing top makes the bit head 40 rotate on the rotational axes P1 and/or P2, and then the bit head 40 retracts into the housing recess 30 formed at the tip face of the device 20.

The excavation tool 10 is driven by a striking device provided in an excavation machine (not shown); and then a rotary force, a striking power, and a thrust are transmitted to the excavation tool 10.

Whereby the device excavating portion 29 and the bit head 40, which are formed at the tip of the excavation tool 10, will break and excavate an object to be excavated, such as a base rock.

In this excavation operation, the fluid supply passage 24 supplies a fluid, such as air, to break an object to be excavated; and then the excavation debris generated in this operation is discharged towards the rear end of the excavation tool 10 via the cutout groove 28.

When an excavation is in operation, the rotation of the device 20 in the rotational direction R1 makes the bit head 40 protrude radially outward, and then a large-diameter excavated hole is bored.

Further, a thrust is transmitted to the casing top 11 to bury the casing pipe 13.

After the excavation of boring an excavated hole has been completed, the rotation of the device 20 in the rotational direction R2 makes the bit head 40 retract into the housing recess 30. Thus, the excavation tool 10 becomes smaller than the internal diameter of the casing pipe 13.

By pulling out the excavation tool 10 in this state, the excavation tool 10 is withdrawn through the inside of the buried casing pipe 13.

In the excavation tool 10 that is the present embodiment, the fixing member 50 made of a rigid body, such as steel, is embedded in the opening of the pin hole 33 into which the locking pin 56 is inserted. The locking pin 56 locks the device 20 and the bit head 40. Thus, it is possible to firmly fix the locking pin 56 without a large elastic deformation of the fixing member 50 caused by an impact or the like during excavation.

Additionally, the locking groove 37, which locks and fixes the fixing member 50 in the extension direction of the pin hole 33 (the insertion direction of the locking pin 56), is provided to prevent the locking pin 56 from moving in the extension direction of the pin hole 33 (the insertion direction of the locking pin 56). Therefore, the coming-off of the locking pin 56 can be reliably prevented.

Additionally, the auxiliary member 53, which maintains the engagement state between the fixing member 50 and the locking groove 37, is embedded therein.

While an excavation is in operation, this auxiliary member 53 can prevent an accident, in which the fixing member 50 comes off the locking groove 37, caused by an impact or the like during excavation. Thus the coming-off of the locking pin 56 can be reliably prevented.

Additionally, the auxiliary member 53 made of an elastic material can maintain the engagement state between the fixing member 50 and the locking groove 37 by using the elastic force of the elastic material; and then the positional deviation of the fixing member 50 can be prevented.

In addition, since the locking pin 56 does not directly contact with the auxiliary member 53 made of the elastic material, the locking pin 56 can be firmly fixed without any elastic deformation of the auxiliary member 53 caused by the pressing force from the locking pin 56.

The sliding groove 34, along which the fixing member 50 slidingly moves, is formed on the outer peripheral surface of the device 20. The loading recess 35 for loading the fixing member 50 into the sliding groove 34 is formed at the rear end of the sliding groove 34. The locking groove 37 is formed at the tip of the loading recess 35.

Thus, inserting the fixing member 50 along the sliding groove 34 from the loading recess 35, and also moving slidingly the fixing member 50; the fixing member 50 is embedded in the opening of the pin hole 33, and can be locked and fixed there by the locking groove 37.

Therefore, the fixing member 50 can be embedded by a simple operation of firmly fixing the locking pin 56.

Next, an excavation tool that is a second embodiment of the invention will be described. The excavation tool that is the second embodiment of the invention is shown in FIGS. 13 to 15. In an excavation tool 110 that is the second embodiment, three bit heads 140 are detachably mounted on the tip of a device 120.

FIGS. 14 and 15, as the views from the tip face, show that three housing recesses 130 are formed point-symmetrically with respect to a central axis O at a tip face of the device body 121.

Additionally, an inclined surface portion 131 is formed at a forward portion in a rotational direction R1 on the inner surface facing to the tip of the housing recess 130. The inclined surface portion 131 gradually retracts radially outward in the direction of the rear end. A fluid discharge hole 127 is open into the inclined surface portion 131. A cutout groove 128 is formed on a side surface of the device 120 which is integrally connected to a radial outer end of the inclined surface portion 131. The cutout groove 128 retreats into one step radially inward, and also extends parallel to the central axis O. Moreover, in this embodiment, a fluid supply passage 124, which extends to a portion nearer to the tip than the bottom surface of an attaching hole 132 described later, is provided. The fluid discharge hole 127; which is connected to a fluid supply passage 124, and is open into the inclined surface portion 131; is provided.

Three attaching holes 132 are formed respectively at backward portions in the rotational direction R1 on the inner surface facing to the tip of the housing recess 130. The attaching holes 132 are eccentric from the central axis O, and also are point-symmetrical with respect to the central axis O as shown in FIGS. 14 and 15. Further the attaching holes 132 extend along three rotational axes P1, P2 and/or P3 which extends parallel to the central axis O as shown in FIG. 13.

Pin holes 133; which extend in a direction perpendicular to the rotational axes, P1, P2, and/or P3, and pass through the attaching holes 132;

are formed at the attaching holes 132, respectively.

In addition, each pin hole 133 has a structure to extend in the radial direction of the device 120.

Sliding grooves 134 are formed at openings of the pin holes 133, respectively. The sliding grooves 134 extend in a direction perpendicular to the extension direction of the pin holes 133 (which extend parallel to the central axis O). Therefore, the three sliding grooves 134 are formed.

The bit head 140 mounted on the attaching hole 132 includes, as shown in FIGS. 13 to 15;

a bit excavating portion 141, in which a plurality of tips 115 made of a hard material, such as a cemented carbide, is implanted; and a substantially cylindrical attaching shaft 145 which extends towards the rear end of the bit excavating portion 141.

An attaching shaft 145 has a structure to fit into the attaching hole 132 which is open into the tip face of the device 120. The axis of the attaching shaft 145 is same as the rotational axes P1, P2, and/or P3.

A groove 146, which is perpendicular to the axis (the rotational axes P1, P2, and/or P3) and extends along the peripheral surface of the attaching shaft 145, is formed on the attaching shaft 145.

The attaching shafts 145 of the bit heads 140 are respectively inserted into the three attaching holes 132 which are open into the tip face of the device 120.

Also, three cylindrical locking pins 156 are respectively inserted into the three pin holes 133 which are open into the sliding grooves 134.

A fixing member 150 is loaded into the sliding groove 134 from the loading recess 135 of the sliding groove 134 so that a flange portion 151 faces radially inward. Then the fixing member 150 is slidingly moved along a locking groove 137. The fixing member 150 abuts on the end face of the locking pin 156, and the flange portion 151 is engaged with the locking groove 137.

Then, the auxiliary member 153, which is elastically deformable, is press-fitted into the loading recess 135. Thus, the fixing member 150 is fixed so as not to move within the sliding groove 134.

In the excavation tool 110 constructed in this way;

rotating the device 120 in the rotational direction R1 shown in FIGS. 14 and 15 by a rotational driving means, the force of the friction with the object to be excavated and/or the casing top makes the bit head 140 rotate on the rotational axes P1, P2 and/or P3, and then the bit excavating portion 141 protrudes radially outward.

On the other hand, rotating the device 120 in the rotational direction R2 shown in FIGS. 14 and 15 by a rotational driving means, the force of the friction with the object to be excavated and/or the casing top makes the bit head 140 rotate on the rotational axes P1, P2 and/or P3, and then the bit excavating portion 141 retracts into the housing recess 130 formed at the tip face of the device 120.

In the excavation tool 110 that is the embodiment constructed in this way, three bit heads 140 are provided for excavation. Thus, for example, even if a large-diameter excavated hole is excavated, a large number of the tips 115 provided in the radial outer portion enable the tool to perform the excavation efficiently.

The fluid supply hole 127 extends to the tip of the device body 121. Thus, supplying a fluid, such as air, to the inside of an excavated hole through the fluid supply hole 127 helps to discharge the excavation debris; and then the excavation operation can be smoothly performed.

Although the excavation tool that is the embodiment of the invention has been described hitherto, the invention is not limited thereto, and can be suitably changed without departing from the technical idea thereof.

The number or arrangement of bit excavating portions and tips to be implanted in each device excavating portion is not particularly limited, and will preferably be appropriately set in consideration of excavation conditions or the like.

Additionally, although the auxiliary member made of an elastic material has been described as one which is press-fitted into the loading recess, the invention is not limited thereto, and auxiliary members of other constructions may be used. For example, as shown in FIGS. 16 and 17, an abutting member 257 may be inserted into a loading recess 235 provided in a sliding groove 234 so as to abut on a flange portion 251 of the fixing member 250, and the abutting member 257 may be fixed by a so-called snap ring 258. That is, the auxiliary member 253 may be composed of the abutting member 257 and the snap ring 258.

Additionally, for example, as shown in FIGS. 18 and 19, a through hole 339 may be provided in a sliding groove 334. The through hole 339 extends in a direction which crosses a sliding direction of the sliding groove 334. A spring pin (auxiliary member) 353, which abuts on a flange portion 351 of a fixing member 350, may be inserted into the through hole 339.

Moreover, although it has been described that a device excavating portion is provided by implanting tips in the tip face of a device, the invention is not limited thereto. For example, as shown in FIGS. 20, 21, 22, and 23, tips 415 and/or 515 may be implanted into bit heads 440 and/or 540.

Additionally, although it has been described in this embodiment that the tool body is used as a device, and the attaching member is used as a bit head, the invention is not limited thereto. For example, as shown in FIGS. 24 to 26, a pilot bit 670 serving as the attaching member may be detachably mounted on an attaching hole 661 extending along the central axis O of a tool body 660, and a locking pin 656 and a fixing member 650 may be utilized for the fixation of the tool body 660 and the pilot bit 670.

Moreover, an attaching hole 662 which is open towards the rear end of the tool body 660 may be provided, an adapter 680 serving as an attaching member to be mounted on the attaching hole 662 may be detachably mounted, and the locking pin 656 and the fixing member 650 may be utilized for the fixation of the tool body 660 and the adapter 680. Additionally, the attaching shaft and the attaching hole may not be limited to the circular cross-sectional shape, but may have a polygonal cross-sectional shape, such as a regular hexagon as shown in FIG. 25, and the locking pin may be attached along a side of the polygonal shape.

INDUSTRIAL APPLICABILITY

Provided is an excavation tool which can firmly fix a locking pin so that the locking pin does not move even in the case of an impact during excavation and/or the locking pin being pushed out in the insertion/removal direction.

The invention claimed is:

1. An excavation tool comprising:

a tool body mounted on a tip of an excavation machine and having an attaching hole, and an attaching member detachably mounted on the tool body; wherein the attaching member is provided with an attaching shaft inserted into the attaching hole;

a groove, which crosses the extension direction of the attaching shaft, is formed in the outer peripheral surface of the attaching shaft;

a pin hole, which extends in a direction crossing the extension direction of the attaching hole, is formed in the tool body;

a part of the pin hole passes through the attaching hole;

a locking pin, which can engage with the groove of the attaching shaft inserted into the attaching hole, is inserted into the pin hole; and an opening of the pin hole is provided with a fixing member which is a rigid body and abuts on the end face of the locking pin to fix the locking pin, and a locking portion which locks the fixing member in the extension direction of the pin hole to fix the fixing member.

2. The excavation tool according to claim 1, wherein an auxiliary member, which maintains an engagement state between the fixing member and the locking portion, is embedded in the tool body.

3. The excavation tool according to claim 2, wherein the auxiliary member is made of an elastic material.

4. The excavation tool according to claim 3, wherein a sliding groove, along which the fixing member slidingly moves, is provided;

the pin hole is opened at one end of the sliding groove together with the locking portion formed thereat; and a loading portion of the fixing member is provided at the other end of the sliding groove.

5. The excavation tool according to claim 4, wherein the tool body is used as a device rotatable on a central axis;

the attaching hole is formed so as to be opened to the tip of the device;

the attaching member is used as a bit head having a bit excavating portion to which a tip made of a hard material is fixed;

the attaching shaft is integrally connected to the bit excavating portion;

the outer peripheral surface of the attaching shaft is provided with a groove, which crosses the extension direction of the attaching shaft and also extends in a peripheral direction;

when the device rotates in one direction, the bit head rotates on the rotational axis, and the bit head also protrudes outward; and when the device rotates in the other direction, the bit head rotates on the rotational axis, and the bit head retract inward.

6. The excavation tool according to claim 3, wherein the tool body is used as a device rotatable on a central axis;

the attaching hole is formed so as to be opened to the tip of the device;

the attaching member is used as a bit head having a bit excavating portion to which a tip made of a hard material is fixed;

the attaching shaft is integrally connected to the bit excavating portion;

the outer peripheral surface of the attaching shaft is provided with a groove, which crosses the extension direction of the attaching shaft and also extends in a peripheral direction;

when the device rotates in one direction, the bit head rotates on the rotational axis, and the bit head also protrudes outward; and when the device rotates in the other direction, the bit head rotates on the rotational axis, and the bit head retract inward.

7. The excavation tool according to claim 2, wherein a sliding groove, along which the fixing member slidingly moves, is provided;

the pin hole is opened at one end of the sliding groove together with the locking portion formed thereat; and a loading portion of the fixing member is provided at the other end of the sliding groove.

8. The excavation tool according to claim 7, wherein the tool body is used as a device rotatable on a central axis;

the attaching hole is formed so as to be opened to the tip of the device;

the attaching member is used as a bit head having a bit excavating portion to which a tip made of a hard material is fixed;

the attaching shaft is integrally connected to the bit excavating portion;

the outer peripheral surface of the attaching shaft is provided with a groove, which crosses the extension direction of the attaching shaft and also extends in a peripheral direction;

when the device rotates in one direction, the bit head rotates on the rotational axis, and the bit head also protrudes outward; and when the device rotates in the other direction, the bit head rotates on the rotational axis, and the bit head retract inward.

9. The excavation tool according to claim 2, wherein the tool body is used as a device rotatable on a central axis;

the attaching hole is formed so as to be opened to the tip of the device;

the attaching member is used as a bit head having a bit excavating portion to which a tip made of a hard material is fixed;

the attaching shaft is integrally connected to the bit excavating portion;

the outer peripheral surface of the attaching shaft is provided with a groove, which crosses the extension direction of the attaching shaft and also extends in a peripheral direction;

when the device rotates in one direction, the bit head rotates on the rotational axis, and the bit head also protrudes outward; and when the device rotates in the other direction, the bit head rotates on the rotational axis, and the bit head retract inward.

10. The excavation tool according to claim 1, wherein a sliding groove, along which the fixing member slidingly moves, is provided;

the pin hole is opened at one end of the sliding groove together with the locking portion formed thereat; and a loading portion of the fixing member is provided at the other end of the sliding groove.

11. The excavation tool according to claim 10, wherein the tool body is used as a device rotatable on a central axis;

the attaching hole is formed so as to be opened to the tip of the device;

the attaching member is used as a bit head having a bit excavating portion to which a tip made of a hard material is fixed;

the attaching shaft is integrally connected to the bit excavating portion;

the outer peripheral surface of the attaching shaft is provided with a groove, which crosses the extension direction of the attaching shaft and also extends in a peripheral direction;

when the device rotates in one direction, the bit head rotates on the rotational axis, and the bit head also protrudes outward; and when the device rotates in the other direction, the bit head rotates on the rotational axis, and the bit head retract inward.

12. The excavation tool according to claim 1, wherein the tool body is used as a device rotatable on a central axis;

the attaching hole is formed so as to be opened to the tip of the device;

the attaching member is used as a bit head having a bit excavating portion to which a tip made of a hard material is fixed;

the attaching shaft is integrally connected to the bit excavating portion;

the outer peripheral surface of the attaching shaft is provided with a groove, which crosses the extension direction of the attaching shaft and also extends in a peripheral direction;

when the device rotates in one direction, the bit head rotates on the rotational axis, and the bit head also protrudes outward; and when the device rotates in the other direction, the bit head rotates on the rotational axis, and the bit head retract inward.

* * * * *